US010692459B2

(12) United States Patent
Jung et al.

(10) Patent No.: US 10,692,459 B2
(45) Date of Patent: Jun. 23, 2020

(54) DISPLAY APPARATUS AND METHOD OF DRIVING THE SAME

(71) Applicant: Samsung Display Co., Ltd., Yongin-Si, Gyeonggi-Do (KR)

(72) Inventors: Woojung Jung, Hwaseong-si (KR); Yong-bum Kim, Suwon-si (KR); Dong-hyun Yeo, Yongin-si (KR); ByungKil Jeon, Hwaseong-si (KR); Yongho Sung, Seongnam-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/163,877

(22) Filed: Oct. 18, 2018

(65) Prior Publication Data

US 2019/0130862 A1 May 2, 2019

(30) Foreign Application Priority Data

Oct. 27, 2017 (KR) ..... 10-2017-0141546

(51) Int. Cl.

| | |
|---|---|
| ***G09G 3/20*** | (2006.01) |
| ***G09G 3/36*** | (2006.01) |
| ***G09G 3/3291*** | (2016.01) |

(52) U.S. Cl.

CPC ..... *G09G 3/3688* (2013.01); *G09G 3/20* (2013.01); *G09G 3/3291* (2013.01); *G09G 2310/0232* (2013.01); *G09G 2310/0243* (2013.01); *G09G 2320/0626* (2013.01); *G09G 2330/021* (2013.01); *G09G 2340/00* (2013.01); *G09G 2340/10* (2013.01)

(58) Field of Classification Search

CPC ..... G09G 3/3688; G09G 3/3291; G09G 2320/0686; G09G 2320/0626; G09G 5/02; G09G 5/10

See application file for complete search history.

(56) References Cited

U.S. PATENT DOCUMENTS 6,115,092 A * 9/2000 Greene ..... G06F 3/147 345/88

6,791,566 B1 9/2004 Kuratomi et al.

(Continued)

FOREIGN PATENT DOCUMENTS

| | | | |
|---|---|---|---|
| JP | 3115727 | B2 | 12/2000 |
| KR | 102020019517 | A | 3/2002 |
| KR | 100708250 | B1 | 4/2007 |

*Primary Examiner* — Sardis F Azongha

(74) *Attorney, Agent, or Firm* — Cantor Colburn LLP

(57) ABSTRACT

A display apparatus includes a signal controller, a panel driver, and a display panel. The signal controller includes N functional blocks that process input image signals to output image data signals and convert input control signals to internal control signals to output the internal control signals. The panel driver converts the image data signals to image data voltages in response to the internal control signals to output the image data voltages and outputs a gate driving voltage. The display panel receives the gate driving voltage and the image data voltages to display an image. A screen of the display panel includes a first area and a second area different from the first area. First input image signals corresponding to the first area among the input image signals are processed by I functional blocks (I is smaller than N) among the N functional blocks.

20 Claims, 11 Drawing Sheets

(56) References Cited

U.S. PATENT DOCUMENTS

| | | | | |
|---|---|---|---|---|
| 8,164,598 | B2 * | 4/2012 | Kimpe | G09G 3/20 345/629 |
| 8,373,728 | B2 * | 2/2013 | Ozawa | G06F 1/3203 345/690 |
| 8,913,092 | B2 * | 12/2014 | Ha | G09G 5/10 345/214 |
| 9,761,193 | B2 | 9/2017 | Kim et al. | |
| 10,152,908 | B2 * | 12/2018 | Pyeon | G09G 3/2022 |
| 2005/0248594 | A1 | 11/2005 | Usui et al. | |
| 2006/0187182 | A1 * | 8/2006 | Yu | G09G 5/10 345/102 |
| 2008/0049051 | A1 * | 2/2008 | Han | G09G 3/006 345/690 |
| 2008/0068324 | A1 * | 3/2008 | Chung | G09G 3/006 345/98 |
| 2013/0201180 | A1 * | 8/2013 | Jeon | G09G 3/3648 345/419 |
| 2014/0198134 | A1 * | 7/2014 | Moon | G09G 5/10 345/690 |
| 2014/0347403 | A1 * | 11/2014 | Song | G09G 3/3258 345/690 |
| 2015/0194107 | A1 * | 7/2015 | Bae | G09G 3/3607 345/696 |
| 2015/0294485 | A1 | 10/2015 | Mok et al. | |

* cited by examiner

DISPLAY APPARATUS AND METHOD OF DRIVING THE SAME

This application claims priority to Korean Patent Application No. 10-2017-0141546, filed on Oct. 27, 2017, and all the benefits accruing therefrom under 35 U.S.C. § 119, the content of which in its entirety is hereby incorporated by reference.

BACKGROUND

1. Field of Disclosure

Exemplary embodiments of the invention relate to a display apparatus and a method of driving the same. More particularly, the invention relates to a display apparatus capable of reducing power consumption and a method of driving the display apparatus.

2. Description of the Related Art

In general, a display apparatus includes a display panel displaying an image, data and gate driving circuits driving the display panel, and a controller controlling the driving of the data and gate driving circuits. The display panel includes gate lines, data lines, and pixels.

The data driving circuit outputs a data driving signal to the data lines, and the gate driving circuit outputs a gate driving signal to drive the gate lines. The display apparatus applies gate signals to the pixels connected to the gate lines and displays the image using data voltages corresponding to a display image.

As a size of the display panel increases and a resolution of the display panel becomes higher, various functional blocks are added to the controller to compensate for characteristics, such as stain, image quality, charge rate, etc., of the display panel.

SUMMARY

When the number of functional blocks increases, the power consumption of the display apparatus increases.

The invention provides a display apparatus capable of reducing power consumption.

The invention provides a method of driving the display apparatus.

According to an exemplary embodiment of the inventive concept, a display apparatus includes a signal controller, a panel driver, and a display unit. The signal controller receives input image signals and input control signals from an outside source, processes the input image signals to output image data signals, and converts the input control signals to internal control signals to output the internal control signals. The signal controller includes N functional blocks that process the input image signals, where N is an integer number equal to or greater than 1.

The panel driver converts the image data signals to image data voltages in response to the internal control signals to output the image data voltages and generates a gate driving voltage to output the gate driving voltage. The display unit receives the gate driving voltage and the image data voltages to display an image. A screen of the display unit, on which the image is displayed, includes a first area and a second area different from the first area. First input image signals correspond to the first area among the input image signals are processed by I functional blocks among the N functional blocks, where I is an integer number equal to or greater than 0 and smaller than N.

According to an embodiment of the inventive concept, a method of driving a display apparatus includes receiving input image signals and input control signals from an outside source, processing the input image signals to providing image data signals, converting the input control signals to internal control signals and transmitting the internal control signals, converting the image data signals to image data voltages in response to the internal control signals to output the image data voltages, generating a gate driving voltage and transmitting the gate driving voltage, and receiving the gate driving voltage and the image data voltages to display an image.

Processing the input image signals to output the image data signals includes selecting one mode of a normal mode and a save mode, processing the input image signals through N functional blocks in the normal mode, where N is an integer number equal to or greater than 1, dividing the input image signals into first input image signals and second input image signals in the save mode, processing the second input image signals through the N functional blocks ("n" is an integer number equal to or greater than 1) to output second image data signals in the save mode, and processing the first input image signals through I functional blocks output first image data signals in the save mode, where I is an integer number equal to or greater than 0 and smaller than N.

According to the above, the data applied to the pixels arranged in the center area with a high visibility rate are processed by N operations, and the data applied to the pixels arranged in the peripheral area with a low visibility rate are processed by I operations.

Accordingly, the use of the functional blocks included in the signal controller is substantially minimized, and thus power consumption in the signal controller may be effectively reduced.

The center area with the high visibility rate has a great influence on the image quality recognized by a viewer, but the peripheral area with the low visibility rate has a small influence on the image quality. Accordingly, although the data corresponding to the peripheral area with the low visibility rate are processed by the I operations, the image quality may be effectively prevented from deteriorating since an overall image quality is not affected.

BRIEF DESCRIPTION OF THE DRAWINGS

The above and other advantages of the invention will become readily apparent by reference to the following detailed description when considered in conjunction with the accompanying drawings wherein.

DETAILED DESCRIPTION

Figure 1:
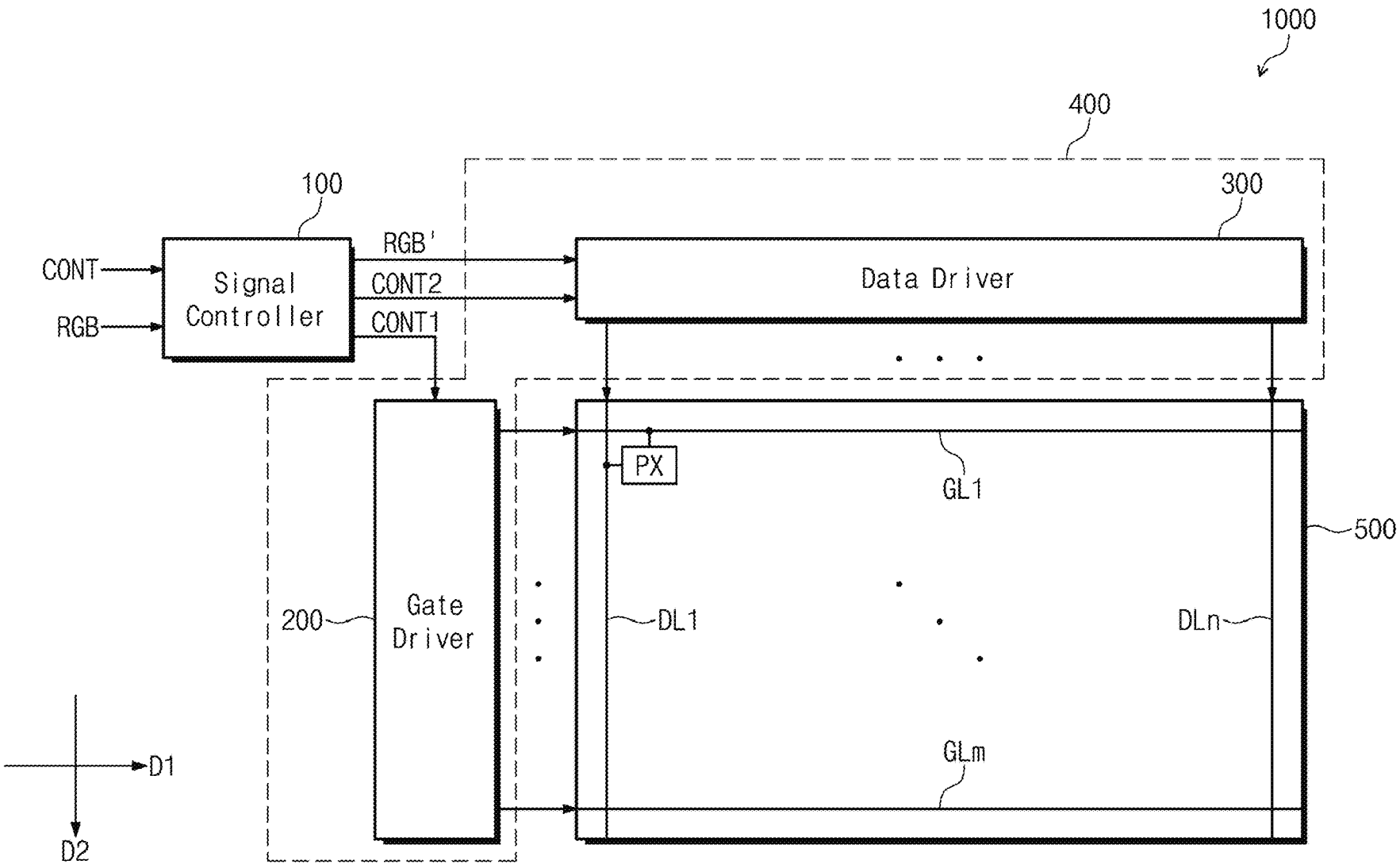
FIG. 1 is a block diagram showing an exemplary embodiment of a display apparatus according to the invention.

The invention may be variously modified and realized in many different forms, and thus specific exemplary embodiments will be exemplified in the drawings and described in detail hereinbelow. However, the invention should not be limited to the specific disclosed forms, and be construed to include all modifications, equivalents, or replacements included in the spirit and scope of the invention.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of staled features, regions, integers, steps, operations, elements, and/or components, but do not preclude the presence or addition of one or more other features, regions, integers, steps, operations, elements, components, and/or groups thereof.

FIG. 1 is a block diagram showing an exemplary embodiment of a display apparatus 1000 according to the invention.

Referring to FIG. 1, the display apparatus 1000 includes a signal controller 100, a panel driver 400, and a display panel 500. The panel driver 400 includes a gate driver 200 and a data driver 300.

The signal controller 100 controls an operation of the panel driver 400. The signal controller 100 receives input image signals RGB and input control signals CONT from an external source, e.g., a host. The input image signals RGB may include red grayscale data R, green grayscale data G, and blue grayscale data B with respect to pixels PX. The input control signals CONT may include a master clock signal, a data enable signal, a vertical synchronization signal, and a horizontal synchronization signal.

The signal controller 100 processes the input image signals RGB and outputs image data signals RGB'. The output image data signals RGB' are applied to the data driver 300. The signal controller 100 may include at least "n" functional blocks (not shown) to process the input image signals RGB. The "n" functional blocks may include functional blocks to perform various operations, e.g., an image quality correction, a stain correction, a color characteristic compensation, and/or an active capacitance compensation with respect to the input image signals RGB.

The signal controller 100 converts the input control signals CONT to internal control signals CONT1 and CONT2 and outputs the internal control signals CONT1 and CONT2. The internal control signals CONT1 and CONT2 include a first control signal CONT1 and a second control signal CONT2. The first control signal CONT1 is applied to the gate driver 200 to control an operation of the gate driver 200. The first control signal CONT1 includes a vertical start signal and a gate clock signal. The second control signal CONT2 is applied to the data driver 300 to control an operation of the data driver 300. The second control signal CONT2 includes a horizontal start signal, a data clock signal, a data load signal, a polarity control signal, an output control signal, or the like.

The panel driver 400 converts the image data signals RGB' to image data voltages in response to the internal control signals CONT1 and CONT2 and outputs the image data voltages. In addition, the panel driver 400 generates gate driving voltages and outputs the gate driving voltages.

In particular, the gate driver 200 in the panel driver 400 generates the gate driving voltages based on the first control signal CONT1 to drive a plurality of gate lines GL1 to GLm. The gate driver 200 sequentially applies the gate driving voltages to the gate lines GL1 to GLm. Accordingly, the pixels PX are sequentially driven by the unit of pixels connected to the same gate line (i.e., the unit of pixels in the same row).

The data driver 300 in the panel driver 400 receives the second control signal CONT2 and the image data signals RGB' from the signal controller 100. The data driver 300 generates the image data voltages in an analog form based on the second control signal CONT2 and the image data signals RGB' in a digital form. The data driver 300 may sequentially apply the image data voltages to the data lines DL1 to DLn.

According to exemplary embodiments, the gate driver 200 and/or the data driver 300 may be mounted on the display panel 500 in a chip form or connected to the display panel 500 in a tape carrier package ("TCP") form or in a chip-on-film ("COF") form. According to other exemplary embodiments, the gate driver 200 and/or the data driver 300 may be integrated in the display panel 500.

The gate driver 200 may be disposed at one or both sides of the display panel 500 to sequentially apply the gate signals to the gate lines GL1 to GLm. FIG. 1 shows an exemplary structure in which the gate driver 200 is disposed at one side of the display panel 500 and connected to one ends of the gate lines GL1 to GLm, but the structure of the gate driver 200 according to the invention should not be limited to that shown in FIG. 1. That is, the display apparatus 1000 may have a dual-gate structure in which the gate drivers are disposed to be connected to both sides of the gate lines GL1 to GLm in another exemplary embodiment.

The display panel 500 includes the pixels PX connected to the gate lines GL1 to GLm and the data lines DL1 to DLn.

The gate lines GL1 to GLm extend in a first direction D1, and the data lines DL1 to DLn extend in a second direction D2 crossing the first direction D1. The pixels PX are arranged in a matrix form, and each of the pixels PX is electrically connected to one of the gate lines GL1 to GLm and one of the data lines DL1 to DLn.

The gate lines GL1 to GLm sequentially receive the gate driving voltages from the gate driver 200 and are turned on. The data lines DL1 to DLn receive the image data voltages from the data driver 300. Accordingly, the image data voltages are applied to the pixels PX connected to the turned-on gate lines through the data lines DL1 to DLn, and the pixels PX to which the image data voltages are applied display an image corresponding to the image data voltages.

Figure 2:
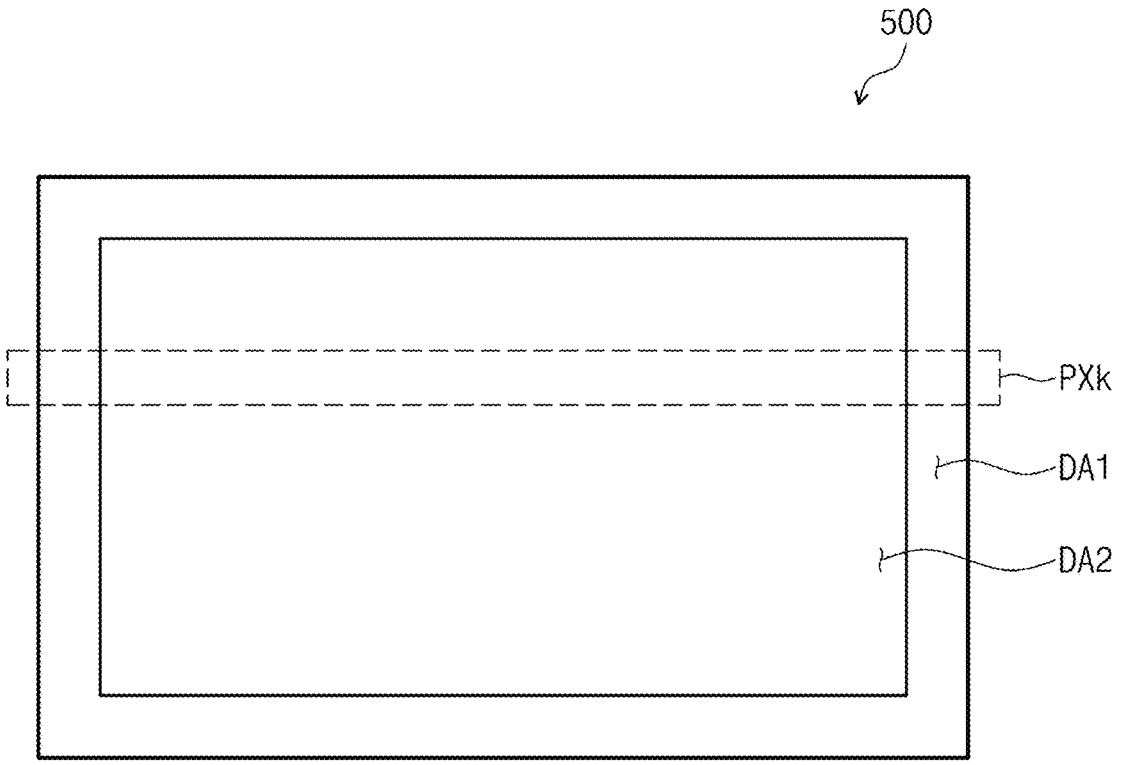
FIG. 2 is a plan view showing an exemplary embodiment of a display panel shown in FIG. 1.

FIG. 2 is a plan view showing an exemplary embodiment of the display panel 500 shown in FIG. 1.

Referring to FIG. 2, the display panel 500 includes a screen on which the image is displayed. The screen includes a first area DA1 and a second area DA2 different from the first area DA1. As an exemplary embodiment of the invention, the second area DA2 corresponds to a center area of the screen, and the first area DA1 corresponds to a peripheral area of the center area.

The image is displayed through both the first and second areas DA1 and DA2, the first and second areas DA1 and DA2 are not distinguishable from one another on the screen by the naked eye, and the first and second areas DA1 and DA2 are divided for the convenience of explanation.

Figure 3:
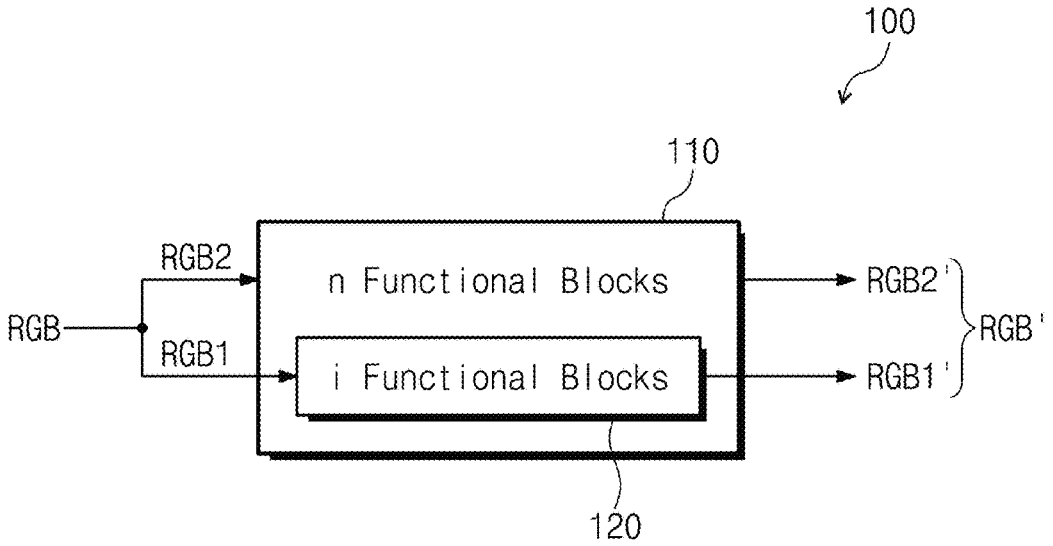
FIG. 3 is a block diagram showing an exemplary embodiment of a signal controller shown in FIG. 1.

FIG. 3 is a block diagram showing an exemplary embodiment of the signal controller 100 shown in FIG. 1.

Referring to FIGS. 2 and 3, the signal controller 100 may include "n" functional blocks 110. The "n" functional blocks 110 may include the functional blocks each of which performs one of various operations, e.g., the image quality correction, the stain correction, the color characteristic compensation, and/or the active capacitance compensation with respect to the input image signals RGB.

Hereinafter, among the input image signals RGB, input image signals related to the first area DA1 are referred to as first input image signals RGB1, and input image signals related to the second area DA2 are referred to as second input image signals RGB2.

The second area DA2 is the area positioned at the center of the screen, and the second input image signals RGB2 related to the second area DA2 may be processed into second image data signals RGB2' after passing through the "n" functional blocks 110. The first area DA1 is the area corresponding to the peripheral area of the screen, and the first input image signals RGB1 related to the first area DA1 may be processed into first image data signals RGB1' after passing only through "i" functional blocks 120 selected from the "n" functional blocks 110. In this exemplary embodiment, the "n" is an integer number equal to or greater than 1, the "i" is an integer number equal to or greater than 0, and the "i" is smaller than the "n". In a case that the "i" is 0, the first input image signals RGB1 may not be processed by any operation. In this case, the first image data signals RGB1' may be the same signals as the first input image signals RGB1.

The signal controller 100 synthesizes the first and the second image data signals RGB1' and RGB2' to generate the image data signals RGB' and applies the generated image data signals RGB' to the data driver 300 of the panel driver 400.

Hereinafter, an operation of the signal controller 100 will be described in detail with reference to accompanying drawings.

Figure 4:
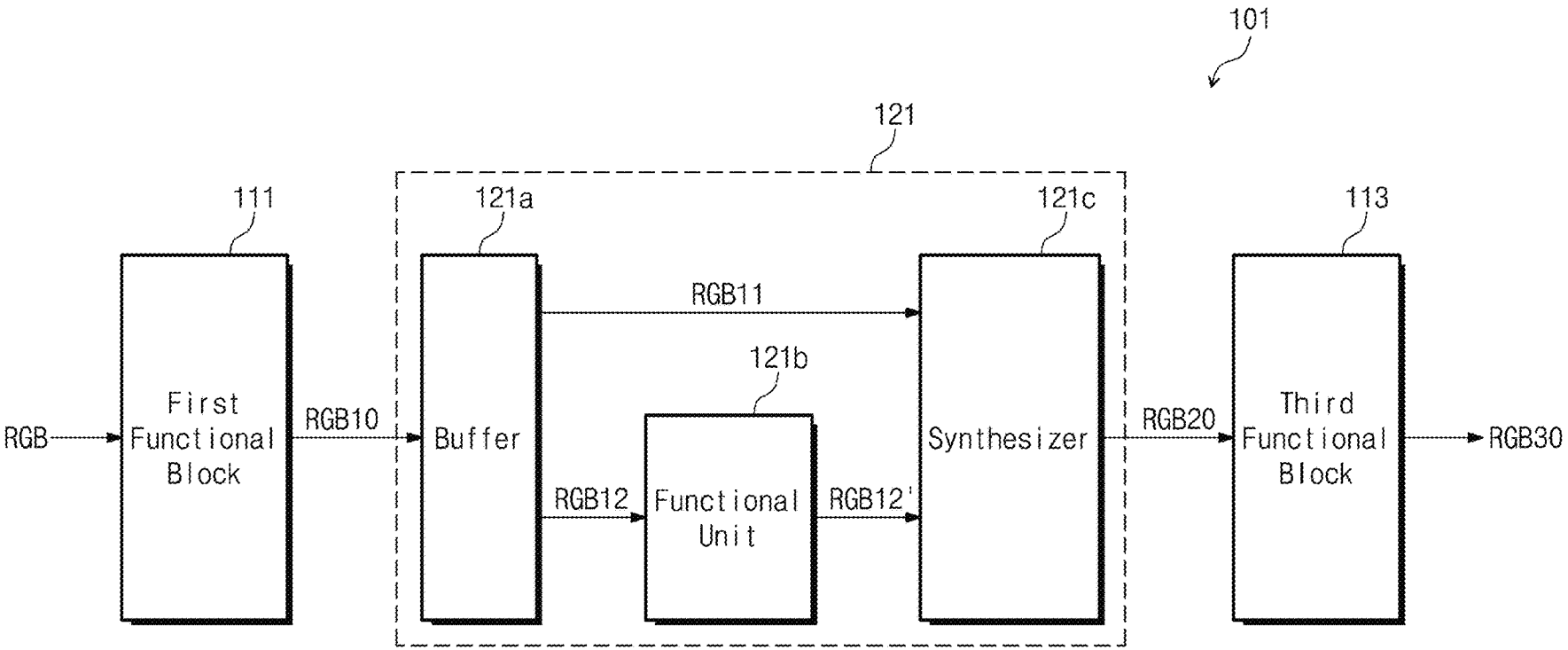
FIG. 4 is a block diagram showing an exemplary embodiment of a signal controller according to the invention.
Figure 5:
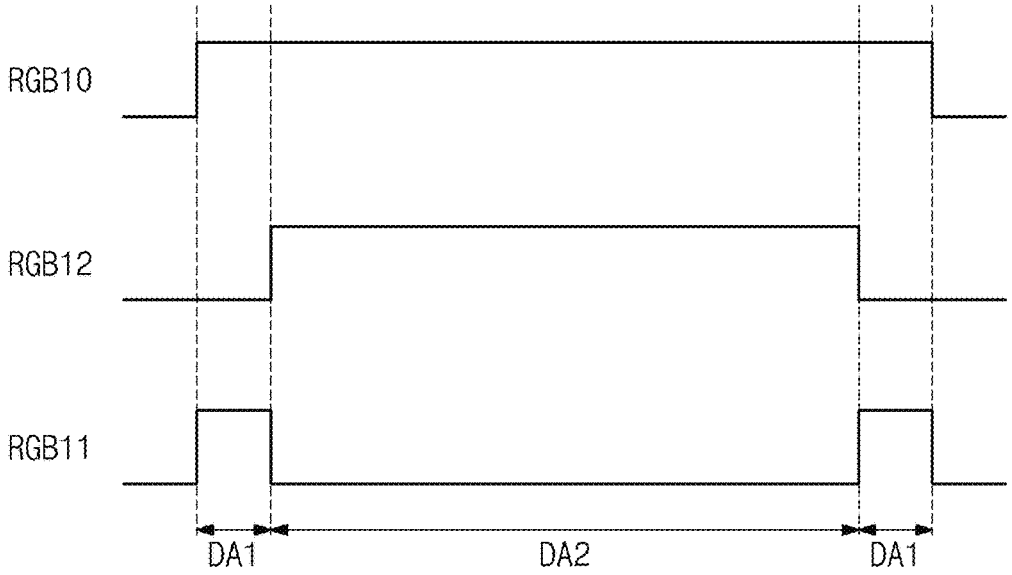
FIG. 5 is a waveform diagram showing exemplary signals of FIG. 4.

FIG. 4 is a block diagram showing an exemplary embodiment of a signal controller 101 according to the invention, and FIG. 5 is a waveform diagram showing exemplary signals of FIG. 4.

Referring to FIG. 4, the signal controller 101 includes a first functional block 111, a second functional block 121, and a third functional block 113. Here, a set of the first, second, third functional blocks 111, 121, and 113 correspond to the "n" functional blocks 110, and the second functional block 121 may correspond to the "i" functional blocks 120 shown in FIG. 3.

Each of the first, second, third functional blocks 111, 121, and 113 may be a functional block that performs at least one of the compensation functions such as the image quality correction, the stain correction, the color characteristic compensation, and the active capacitance compensation. In FIG. 4, the first, second, and third functional blocks 111, 121, and 113 are sequentially connected to each other to stepwise perform the compensation functions. However, some of the first, second, and third functional blocks 111, 121, and 113 may be connected to each other in parallel to selectively perform the compensation functions in another exemplary embodiment.

FIG. 4 shows a structure in which the signal controller 101 includes three functional blocks 111, 121, and 113, but the number of the functional blocks should not be limited to three. In addition, the "i" functional blocks are defined as the second function block 121 in FIG. 4, but the number and structure of the "i" functional blocks should not be limited thereto or thereby.

The input image signals RGB are input to the first functional block 111 and processed by the first functional block 111, and the first functional block 111 outputs first processed image signals RGB10 as a result of the process. The first processed image signals RGB10 are input to the second functional block 121 to be processed by a next operation.

In an exemplary embodiment, as an example, the second functional block 121 includes a buffer 121*a*, a functional unit 121*b*, and a synthesizer 121*c*. The buffer 121*a* divides the first processed image signals RGB10 into first image signals RGB11 and second image signals RGB12.

As shown in FIGS. 2, 4, and 5, the first processed image signals RGB10 may be a collection of data applied to the pixels in the same row (e.g., a k-th row's pixels PXk) of the screen of the display panel 500. Here, the second image signals RGB12 may be a collection of data applied to the pixels arranged in the second area DA2 of the k-th row's pixels PXk, and the first image signals RGB11 may be a collection of data applied to the pixels arranged in the first area DA1 of the k-th row's pixels PXk.

Since the first image signals RGB11 are data applied to the pixels arranged in the first area DA1 corresponding to the peripheral area of the screen among the first processed image signals RGB10, the first image signals RGB11 may be directly provided to the synthesizer 121*c* without passing through the functional unit 121*b*. On the other hand, the second image signals RGB12 applied to the pixels arranged in the second area DA2 corresponding to the center area of the screen among the first processed image signals RGB10 are provided to the synthesizer 121*c* after being processed into second sub-processed signals RGB12' by the functional unit 121*b*.

The synthesizer 121*c* synthesizes the first image signals RGB11 and the second sub-processed signals RGB12' to generate second processed image signals RGB20. The second processed image signals RGB20 are input to the third functional block 113 to be processed by a next operation. The third functional block 113 processes the second processed image signals RGB20 and outputs third processed image signals RGB30.

In a case that the third functional block 113 is located at a position corresponding to the last processing operation of the signal controller 101, the third processed image signals RGB30 may be applied to the data driver 300 as the image data signals RGB'. As another embodiment, when the signal controller 101 further includes a functional block located next to the third functional block 113, the third processed image signals RGB30 may be applied to the functional block located next to the third functional block 113.

According to the above-mentioned exemplary embodiment, the data applied to the pixels arranged in the center area DA2 with a high visibility rate are processed by "n" operations, and the data applied to the pixels arranged in the peripheral area DA1 with a low visibility rate are processed by "i" operations. Accordingly, the use of the functional blocks included in the signal controller 101 is substantially minimized, and thus power consumption in the signal controller 101 may be effectively reduced. The center area DA2 with the high visibility rate has a great influence on the image quality recognized by a viewer, but the peripheral area DA1 with the low visibility rate has a small influence on the image quality. Accordingly, although the data corresponding to the peripheral area DA1 with the low visibility rate are processed by the "i" operations which is less than "n" operations, deterioration of the image quality may be effectively prevented since an overall image quality recognized by a viewer is not affected even in the few operations for the image corresponding to the peripheral area DA1.

Figure 6:
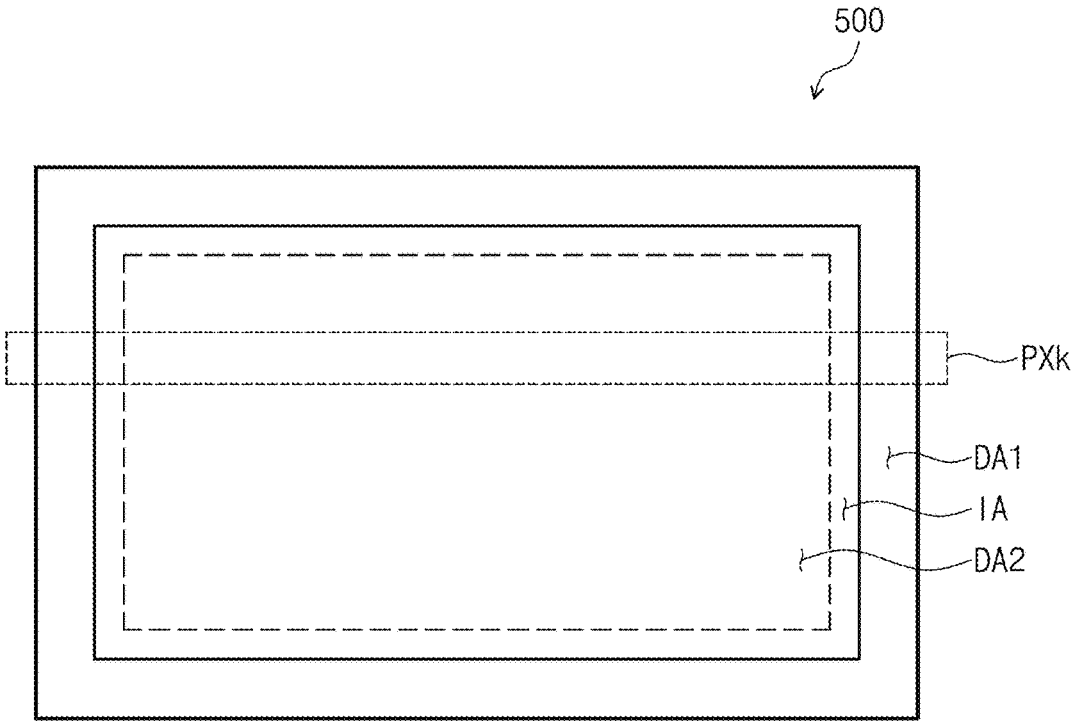
FIG. 6 is a plan view showing another exemplary embodiment of a display panel according to the invention.

FIG. 6 is a plan view showing another exemplary embodiment of a display panel 500 according to the invention.

Referring to FIG. 6, the display panel 500 includes a screen on which an image is displayed. The screen includes a first area DA1 and a second area DA2 different from the first area DA1. In an exemplary embodiment, as an example of the invention, the second area DA2 corresponds to a center area of the screen, and the first area DA1 corresponds to a peripheral area adjacent to surround the center area DA2.

The image is displayed through both the first and second areas DA1 and DA2, the first and second areas DA1 and DA2 are not distinguishable from one another on the screen by the naked eye, and the first and second areas DA1 and DA2 are divided for the convenience of explanation.

In an exemplary embodiment, as an example, an edge area of the second area DA2, which is adjacent to the first area DA1, may be defined as an interpolation area IA. That is, the interpolation area IA may be defined at a boundary between the second area DA2 and the first area DA1.

Figure 7:
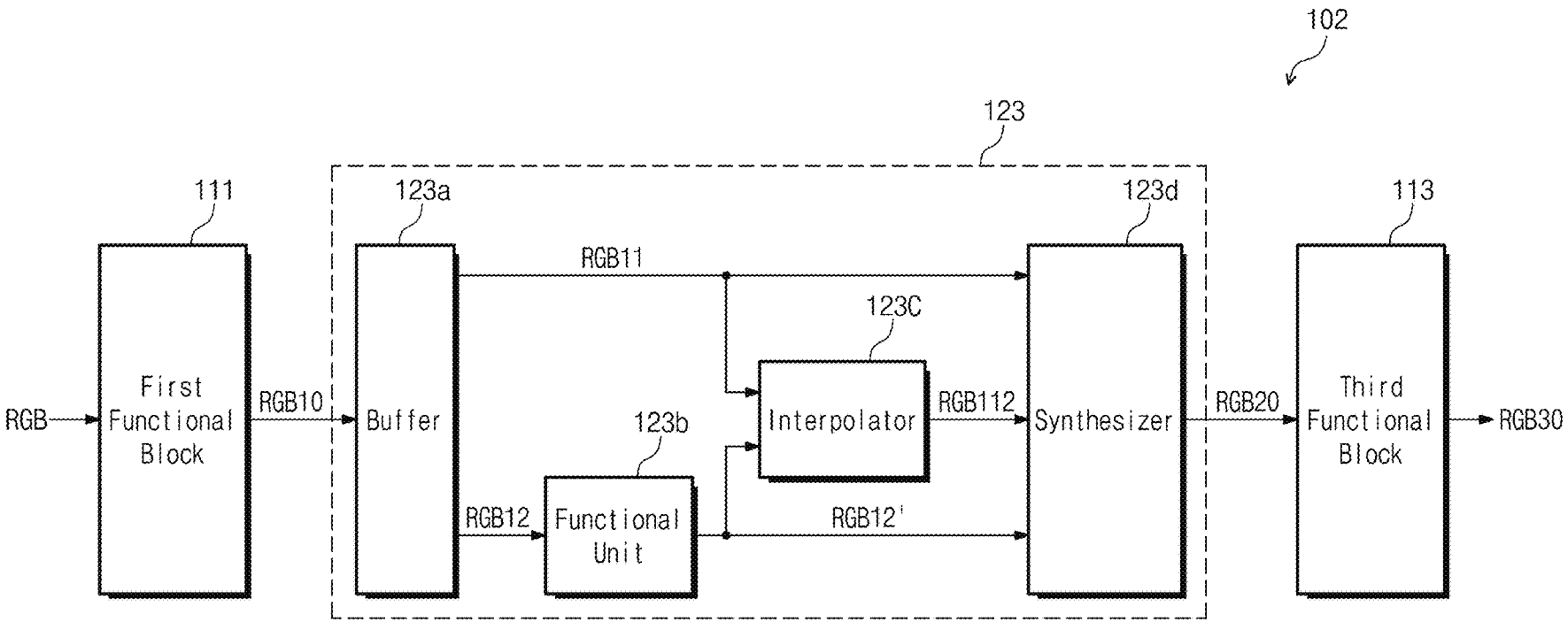
FIG. 7 is a block diagram showing another exemplary embodiment of a signal controller according to the invention.
Figure 8:
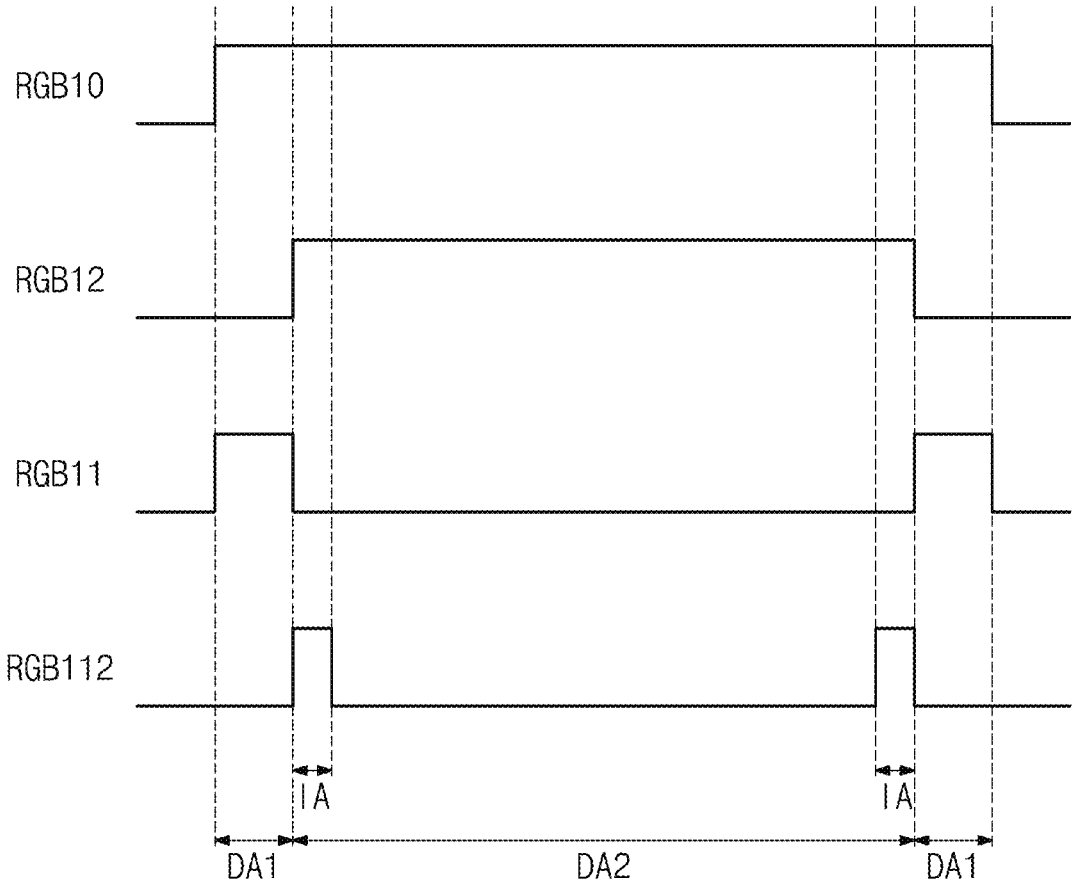
FIG. 8 is a waveform diagram showing exemplary signals of FIG. 7.

FIG. 7 is a block diagram showing another exemplary embodiment of a signal controller 102 according to the invention, and FIG. 8 is a waveform diagram showing signals of FIG. 7. In FIG. 7, the same reference numerals denote the same elements in FIG. 4, and thus detailed descriptions of the same elements will be omitted.

Referring to FIG. 7, the signal controller 102 includes a first functional block 111, a second functional block 123, and a third functional block 113.

The input image signals RGB are input to the first functional block 111 and processed by the first functional block 111, and the first functional block 111 outputs first processed image signals RGB10 as a result of the process. The first processed image signals RGB10 are input to the second functional block 123 to be processed by a next operation.

In an exemplary embodiment, as an example, the second functional block 123 may include a buffer 123*a*, a functional unit 123*b*, an interpolator 123*c*, and a synthesizer 123*d*. The buffer 123*a* divides the first processed image signals RGB10 into first image signals RGB11 and second image signals RGB12.

As shown in FIGS. 6 to 8, the first processed image signals RGB10 may be a collection of data applied to the pixels in the same row (e.g., a k-th row's pixels PXk) of the screen of the display panel 500. Here, the second image signals RGB12 may be a collection of data applied to the pixels arranged in the second area DA2 of the k-th row's pixels PXk, and the first image signals RGB11 may be a collection of data applied to the pixels arranged in the first area DA1 of the k-th row's pixels PXk.

The first image signals RGB11 are data applied to the pixels arranged in the peripheral area DA1 and do not pass through the functional unit 123*b*. However, the second image signals RGB12 applied to the pixels arranged in the center area DA2 are processed into second sub-processed signals RGB12' while passing through the functional unit 123*b*.

The interpolator 123*c* receives the first image signals RGB11 and the second sub-processed signals RGB12'.

The interpolator 123*c* receives the first image signals RGB11 that are not processed and the second sub-processed signals RGB12' that are processed by the functional unit 123*b* and then generates interpolation image signals RGB112. In particular, the interpolator 123*c* extracts an edge portion signal corresponding to the interpolation area IA shown in FIG. 6 among the second sub-processed signals RGB12' and interpolates the edge portion signal based on the first image signal RGB11 to generate the interpolation image signals RGB112.

The interpolator 123*c* may generate the interpolation image signals RGB112 based on the following Equation.

$$Cdata=(Adata-Bdata)\times Wt+Bdata \quad \text{<Equation>}$$

In Equation, Cdata denotes the interpolation image signals RGB112, Adata denotes the edge portion signal, Bdata denotes the first image signals RGB11, and Wt denotes a weight.

The interpolator 123*c* may interpolate the edge portion signal using one weight in this exemplary embodiment. However, according to another embodiment, the second area DA2 may include a plurality of interpolation areas. In this case, the interpolator 123*c* may apply different weights to the interpolation areas, respectively, and generate the interpolation image signals RGB112 corresponding to the interpolation areas, respectively.

The synthesizer 123*d* synthesizes the first image signals RGB11, the interpolation image signals RGB112, and the second sub-processed signals RGB12' to generate second processed image signals RGB20. The second processed image signals RGB20 are input to the third functional block 113 to be processed by a next operation. The third functional block 113 processes the second processed image signals RGB20 to output third processed image signals RGB30.

According to the above-mentioned exemplary embodiment, the data applied to the pixels arranged in the center area DA2 with the high visibility rate are processed by "n" operations, and the data applied to the pixels arranged in the peripheral area DA1 with the low visibility rate are processed by "i" operations. Accordingly, the use of the functional blocks included in the signal controller 102 is substantially minimized, and thus power consumption in the signal controller 102 may be effectively reduced.

In addition, since the signal controller 102 further includes the interpolator 123*c* to improve a difference in image quality between the center area DA2 and the peripheral area DA1 at the border between the areas, the interpolation operation may be performed on image corresponding to a portion of the center area DA2 adjacent to the peripheral area DA1. Accordingly, the difference in image quality between the center area DA2 and the peripheral area DA1 at the border between the areas may be effectively prevented from being perceived by the user.

Figure 9:
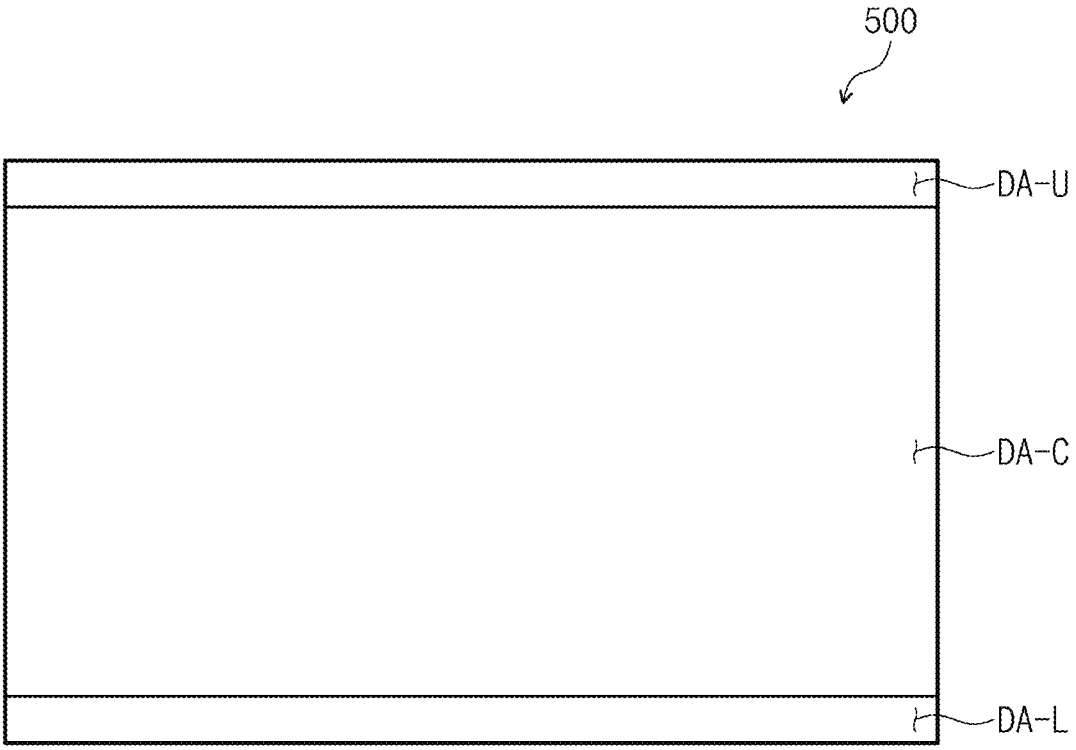
FIG. 9 is a plan view showing still another exemplary embodiment of a display panel according to the invention.
Figure 10:
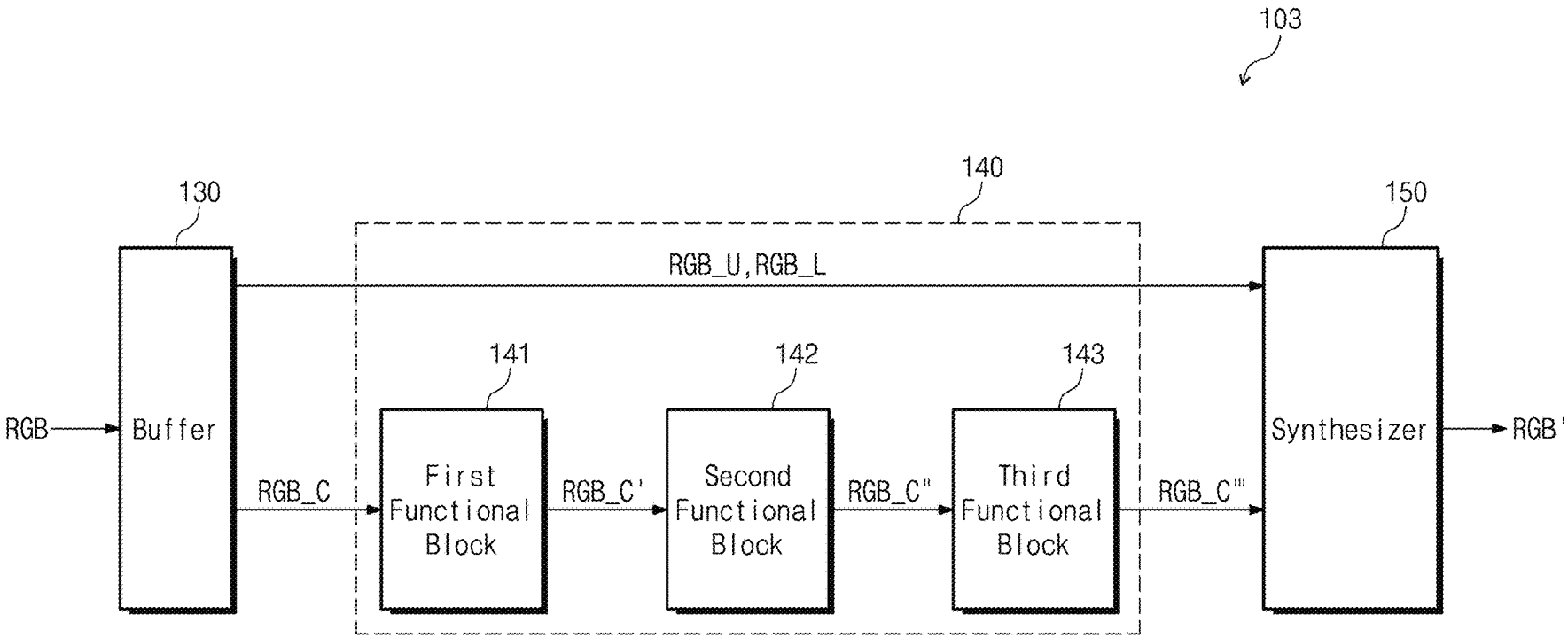
FIG. 10 is a block diagram showing still another exemplary embodiment of a signal controller according to the invention.

FIG. 9 is a plan view showing still another exemplary embodiment of a display panel 500 according to the invention, and FIG. 10 is a block diagram showing still another exemplary embodiment of a signal controller 103 according to the invention.

Referring to FIG. 9, the display panel 500 includes a screen on which an image is displayed. The screen includes a center area DA-C, an upper area DA-U defined above the center area DA-C, and a lower area DA-L defined below the center area DA-C.

In a case that a display mode is a cinema mode to display movies, the image may be displayed only on the center area DA-C, and the image may not be displayed on the upper and lower areas DA-U and DA-L. Even if the display mode is not the cinema mode, the image may be displayed only on a portion of the screen and may not be displayed on the other portions of the screen, or a still image or a caption may be displayed on the other portions. In this case, the area on which the image is displayed may be referred to as the "center area DA-C", and the other portions may be referred to as the "upper and lower areas DA-U and DA-L.

Referring to FIG. 10, the signal controller 103 according to still another embodiment of the invention includes a buffer 130, "n" functional blocks 140, and a synthesizer 150. In an exemplary embodiment, as an example, the "n" functional blocks 140 includes a first functional block 141, a second functional block 142, and a third functional block 143.

Each of the first, second, and third functional blocks 141, 142, and 143 may be a functional block that performs at least one of the compensation functions such as the image quality correction, the stain correction, the color characteristic compensation, and the active capacitance compensation. In FIG. 10, the first, second, and third functional blocks 141, 142, and 143 are sequentially connected to each other to stepwise perform the compensation functions. However, some of the first, second, and third functional blocks 141, 142, and 143 may be connected to each other in parallel to selectively perform the compensation functions in another exemplary embodiment.

FIG. 10 shows an exemplary structure in which the signal controller 103 includes three functional blocks 141, 142, and 143, but the number of the functional blocks according to the invention should not be limited to three.

The input image signals RGB are input to the buffer 130 and are divided into center image signals RGB_C, upper image signals RGB_U, and lower image signals RGB_L.

As shown in FIGS. 9 and 10, the center image signals RGB_C may be a collection of data applied to the pixels arranged in the center area DA-C of the display panel 500. Here, the upper image signals RGB_U may be a collection of data applied to the pixels arranged in the upper area DA-U, and the lower image signals RGB_L may be a collection of data applied to the pixels arranged in the lower area DA-L.

The center image signals RGB_C are applied to the "n" functional blocks 140 to be processed. In detail, the center image signals RGB_C are input to the first functional block 141 and processed by the first function block 141, and the first function block 141 outputs first processed center image signals RGB_C' as a result of the process. The first processed center image signals RGB_C' are input to the second functional block 142 to be processed by a next operation. The first processed center image signals RGB_C' are processed by the second functional block 142 and, the second functional block 142 outputs second processed center image signals RGB_C" as a result of the process. Then, the second processed center image signals RGB_C" are input to the third functional block 143 and processed by the third functional block 143, and the third functional block 143 outputs third processed center image signals RGB_C"' as a result of the process. The output third processed center image signals RGB_C"' are applied to the synthesizer 150.

The upper image signals RGB_U and the lower image signals RGB_L may be directly applied to the synthesizer 150 without passing through the "n" functional blocks 140.

The synthesizer 150 synthesizes the third processed center image signals RGB_C"', the upper image signals RGB_U, and the lower image signals RGB_L to generate image data signals RGB'. The generated image data signals RGB' may be applied to the data driver 300 (refer to FIG. 1) of the panel driver 400 (refer to FIG. 1).

According to the above-described exemplary embodiments, the processing operation for the data applied to the upper and lower areas DA-U and DA-L in which no image is displayed as the cinema mode may be omitted, and thus the power consumption in the signal controller 103 may be effectively reduced.

Figure 11:
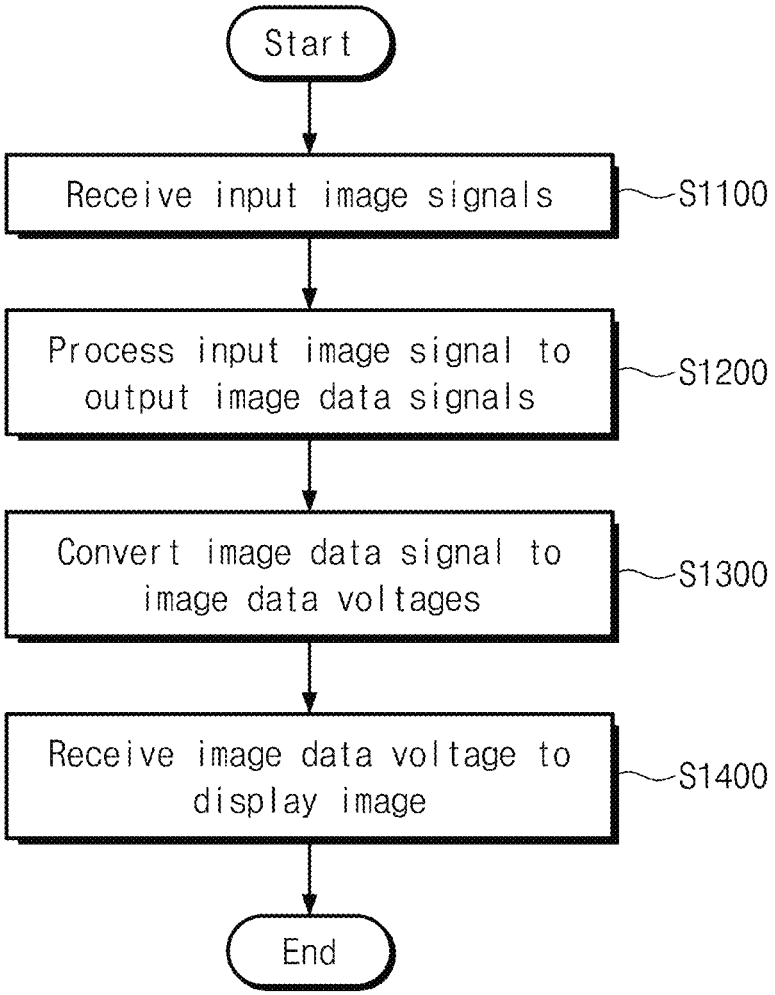
FIG. 11 is a flowchart showing an exemplary embodiment of a method of driving a display apparatus according to the invention.
Figure 12:
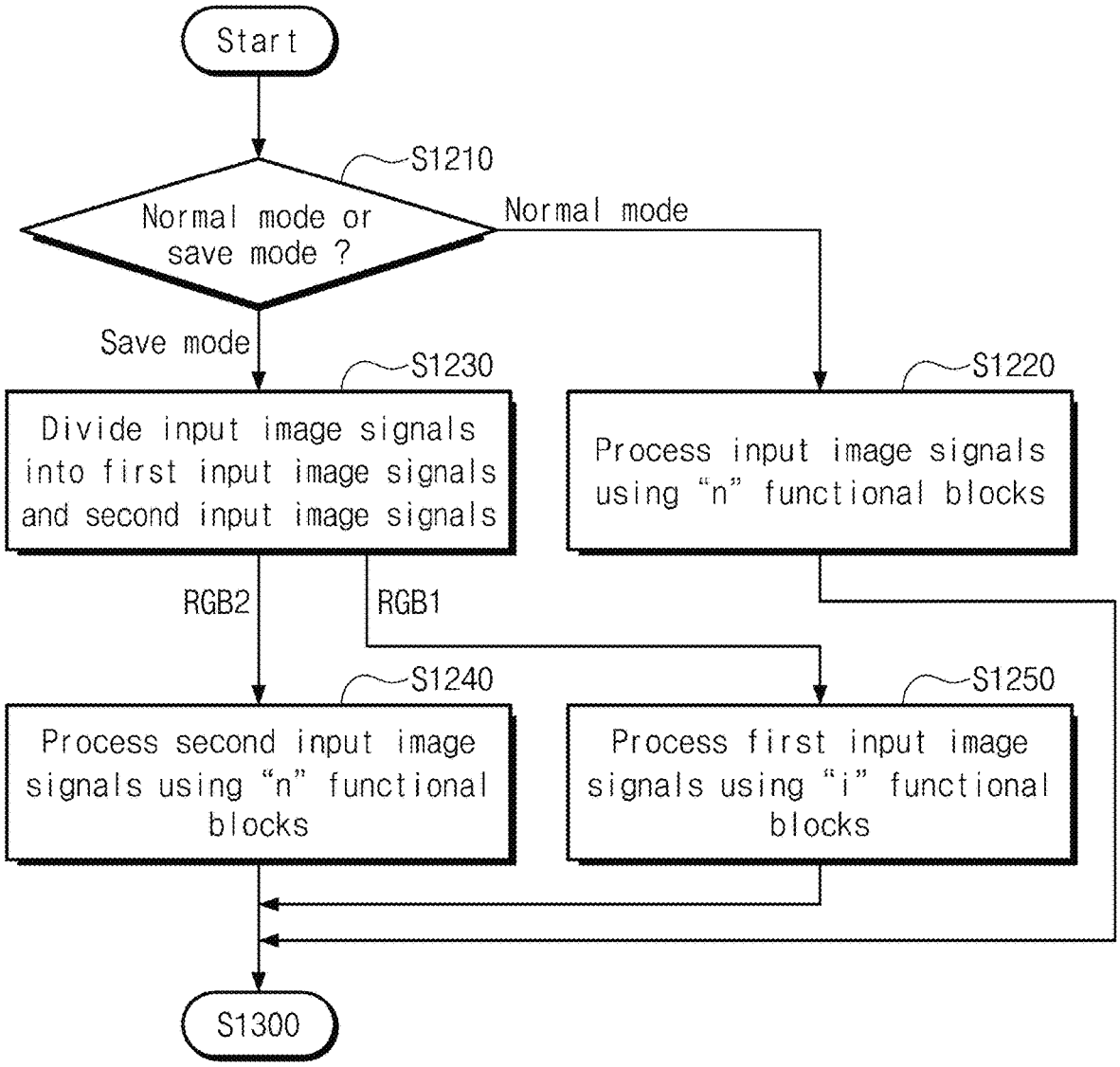
FIG. 12 is a flowchart showing an exemplary embodiment of operations of processing an input image signal and outputting an image data signal of FIG. 11.

FIG. 11 is a flowchart showing an exemplary embodiment of a method of driving a display apparatus according to the invention, and FIG. 12 is a flowchart showing an exemplary embodiment of operations of processing an input image signal and outputting an image data signal of FIG. 11.

Referring to FIG. 11, the display apparatus according to the exemplary embodiment of the invention receives the input image signals and the input control signals (S1100). Then, the signal controller processes the input image signals to output the image data signals and converts the input control signals to the internal control signals to output the internal control signals (S1200). The panel driver converts the image data signals to the image data voltages in response to the internal control signals and outputs the image data voltages. In addition, the panel driver generates and outputs a gate driving voltage (S1300). The display panel receives the gate driving voltages and the image data voltages and displays the image based on the gate driving voltages and the image data voltages (S1400).

Referring to FIG. 12, the signal controller may select one of a normal mode and a save mode in order to process the input image signals and output the image data signals (S1210). When the normal mode is selected, the input image signals are processed by the "n" functional blocks ("n" is an integer number equal to or greater than 1) (S1220). When the save mode is selected, the input image signals may be divided into first input image signals RGB1 and the second input image signals RGB2 (S1230). The second input image signals RGB2 are processed by the "n" functional blocks ("n" is an integer number equal to or greater than 1) and the signal controller outputs the second image data signals as a result of the process (S1240), and the first input image signals RGB1 are processed by the "i" functional blocks ("i" is an integer number equal to or greater than 0 and smaller than the "n") and the signal controller outputs the first image data signals as a result of the process (S1250).

Here, the second input image signals RGB2 are signals corresponding to the center area DA2 (refer to FIG. 2) of the screen on which the image is displayed, and the first input image signals RGB1 are signals corresponding to the peripheral area DA1 of the center area DA2.

Although not shown in figures, the signal controller according to the driving method may synthesize the first image data signals and the second image data signals to output the image data signals.

Figure 13:
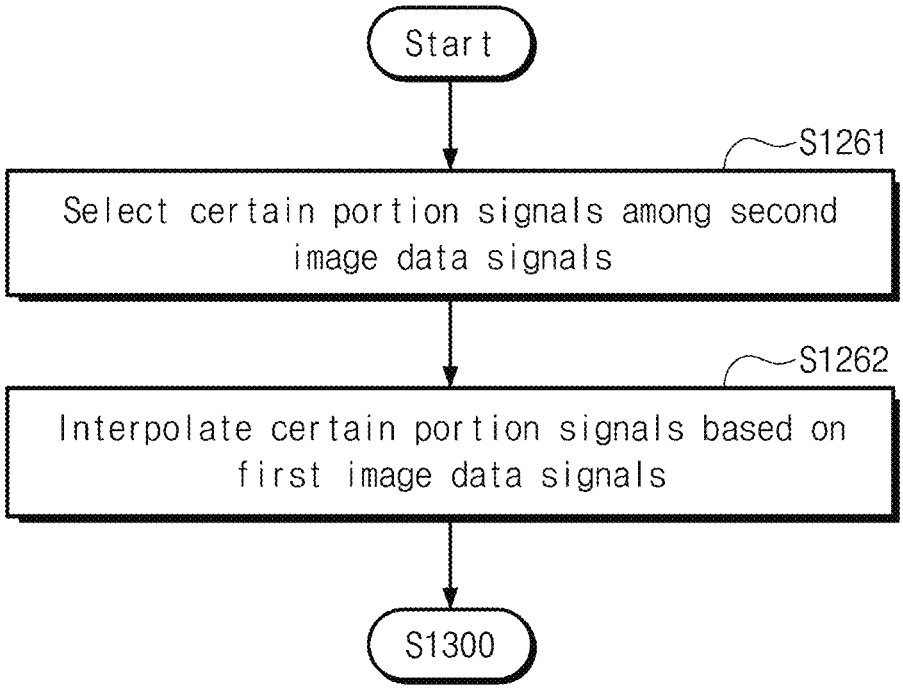
FIG. 13 is a flowchart showing another exemplary embodiment of a method of driving a display apparatus according to the invention.

FIG. 13 is a flowchart showing another exemplary embodiment of a method of driving a display apparatus according to the invention.

Referring to FIG. 13, in a case that the interpolation operation is performed in the save mode, the driving method of the display apparatus may further include selecting a certain portion signals of the second image data signals (S1261). Here, the certain portion signals may be signals corresponding to the edge area IA of the center area DA2 (refer to FIG. 6) adjacent to peripheral area DA1 (refer to FIG. 6).

Then, the certain portion signals are interpolated based on the first image data signals to output the interpolation image signals (S1262).

Although not shown in FIG. 13, the signal controller according to the driving method may synthesize the first image data signals, the interpolation image signals, and the second image data signals to output the synthesized result as the image data signals.

In addition, functional blocks that do not process the first input image signals among the "n" functional blocks in the save mode may include an interpolator to interpolate the second image data signals based on the first input image signals. The interpolator s operated in the similar manner to that of the interpolator 123*c* shown in FIG. 7, and thus details thereof will be omitted.

Although the exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A display apparatus comprising:

a signal controller which receives input image signals and input control signals from an outside source, processes the input image signals to output image data signals, converts the input control signals to internal control signals to output the internal control signals, and comprises N functional blocks that process the input image signals, wherein N is an integer number equal to or greater than 1;

a panel driver which converts the image data signals to image data voltages in response to the internal control signals to output the image data voltages and generates a gate driving voltage to output the gate driving voltage; and a display unit which receives the gate driving voltage and the image data voltages to display an image, wherein a screen of the display unit, on which the image is displayed, comprises a first area and a second area different from and not overlapping the first area, the first area and second area are coplanar defining the screen, and first input image signals corresponding to the first area among the input image signals are processed by I functional blocks among the N functional blocks, wherein I is an integer number equal to or greater than 0 and smaller than N.

2. The display apparatus of claim 1, wherein second input image signals corresponding to the second area are processed by the N functional blocks.

3. The display apparatus of claim 2, wherein at least one functional block among the N functional blocks comprises:

a buffer which divides image signals provided thereto into first image signals and second image signals and outputs the first image signals and the second image signals;

a functional unit which processes the second image signals output from the buffer and outputs sub-processed image signals; and a synthesizer which synthesizes the first image signals and the sub-processed image signals to output the image data signals.

4. The display apparatus of claim 3, wherein the second area corresponds to a center area of the screen, and the first area corresponds to a peripheral area of the center area.

5. The display apparatus of claim 3, wherein an edge area of the second area, which is adjacent to the first area, is defined as an interpolation area, and the sub-processed image signals comprise portion signals corresponding to the interpolation area.

6. The display apparatus of claim 5, wherein the at least one functional block further comprises an interpolator that interpolates the portion signals based on the first image signals and outputs interpolation image signals.

7. The display apparatus of claim 6, wherein the interpolator generates the interpolation image signals based on the following Equation of $$C\text{data}=(A\text{data}-B\text{data})\times Wt+B\text{data},$$

wherein Cdata denotes the interpolation image signals, Adata denotes the portion signals, Bdata denotes the first image signals, and Wt denotes a weight.

8. The display apparatus of claim 7, wherein the second area comprises a plurality of interpolation areas, and the interpolator applies different weights to the interpolation areas, respectively, and generates the interpolation image signals corresponding to the interpolation areas, respectively.

9. The display apparatus of claim 6, wherein the synthesizer synthesizes the sub-processed image signals, the interpolation image signals, and the first image signals and outputs the synthesized result as the image data signals.

10. The display apparatus of claim 2, wherein the signal controller further comprises a buffer which divides the input image signals into the first input image signals and second input image signals and outputs the first input image signals and the second input image signals, and the N functional blocks process the second input image signals output from the buffer to output processed image signals.

11. The display apparatus of claim 10, wherein the signal controller further comprises a synthesizer that synthesizes the first input image signals and the processed image signals and outputs the synthesized result as the image data signals.

12. A method of driving a display apparatus, comprising:

receiving input image signals and input control signals from an outside source;

processing the input image signals to providing image data signals;

converting the input control signals to internal control signals and transmitting the internal control signals;

converting the image data signals to image data voltages in response to the internal control signals to output the image data voltages;

generating a gate driving voltage and transmitting the gate driving voltage; and receiving the gate driving voltage and the image data voltages to display an image, wherein processing the input image signals to output the image data signals comprises:

selecting one mode of a normal mode and a save mode;

processing the input image signals through N functional blocks in the normal mode, wherein N is an integer number equal to or greater than 1;

dividing the input image signals into first input image signals and second input image signals in the save mode;

processing the second input image signals through the N functional blocks to output second image data signals in the save mode; and processing the first input image signals through I functional blocks to output first image data signals in the save mode, wherein I is an integer number equal to or greater than 0 and smaller than N.

13. The method of claim 12, further comprising synthesizing the first image data signals and the second image data signals in the save mode to output the synthesized result as the image data signals.

14. The method of claim 12, wherein the second input image signals are signals corresponding to a center area of a screen on which the image is displayed, and the first input image signals are signals corresponding to a peripheral area of the center area.

15. The method of claim 14, further comprising:

selecting portion signals among the second image data signals in the save mode; and interpolating the portion signals based on the first image data signals to output interpolation image signals in the save mode.

16. The method of claim 15, wherein the portion signals are signals corresponding to an edge area of the center area, which is adjacent to the peripheral area.

17. The method of claim 15, wherein the interpolation image signals are generated based on the following Equation of $Cdata=(Adata-Bdata)\times Wt+Bdata$, wherein Cdata denotes the interpolation image signals, Adata denotes the portion signals, Bdata denotes the first image data signals, and Wt denotes a weight.

18. The method of claim 17, wherein the interpolation image signals are generated by applying different weights.

19. The method of claim 15, wherein the first image signals, the interpolation image signals, and second image signals are synthesized, and the synthesized result is output as the image data signals.

20. The method of claim 12, wherein functional blocks which do not process the first input image signals among the N functional blocks further comprise an interpolator to interpolate the second image data signals based on the first input image signals.

* * * * *